US012601238B2

(12) United States Patent
Shukla et al.

(10) Patent No.: US 12,601,238 B2
(45) Date of Patent: Apr. 14, 2026

(54) BULK METALLIC GLASS REINFORCED ELASTOMER FOR DOWNHOLE APPLICATIONS

(71) Applicant: Halliburton Energy Services, Inc., Houston, TX (US)

(72) Inventors: Shashwat Shukla, Singapore (SG); Somen Kumar Bhudolia, Singapore (SG); Sandeep Thatathil, Singapore (SG); Arpana Singh, Singapore (SG)

(73) Assignee: Halliburton Energy Services, Inc., Houston, TX (US)

( * ) Notice: Subject to any disclaimer, the term of this patent is extended or adjusted under 35 U.S.C. 154(b) by 127 days.

(21) Appl. No.: 18/520,851

(22) Filed: Nov. 28, 2023

(65) Prior Publication Data

US 2025/0172052 A1 May 29, 2025

(51) Int. Cl.
*E21B 33/12* (2006.01)

(52) U.S. Cl.
CPC ..... *E21B 33/1208* (2013.01)

(58) Field of Classification Search
CPC ..... E21B 33/10
See application file for complete search history.

(56) References Cited

U.S. PATENT DOCUMENTS

| | | | | |
|---|---|---|---|---|
| 6,409,874 | B1 | 6/2002 | Van Der Aar et al. | |
| 2010/0181729 | A1* | 7/2010 | Slay | B82Y 30/00 277/336 |
| 2014/0083764 | A1 | 3/2014 | Fadul et al. | |
| 2015/0337615 | A1 | 11/2015 | Epstein et al. | |
| 2017/0283589 | A1 | 10/2017 | Zhao et al. | |
| 2021/0396101 | A1 | 12/2021 | Fripp et al. | |
| 2023/0340854 | A1 | 10/2023 | Fripp et al. | |

OTHER PUBLICATIONS

Investigation of contact surfaces between polymer matrix and metallic glassses in composite materials based on high density polethylene (Year: 2016).*

Zhong, A. (2016). Challenges for High-Pressure High-Temperature Applications of Rubber Materials in the Oil and Gas Industry. Conference Proceedings of the Society for Experimental Mechanics Series, 65-79.

Shashwat Shukla; Agnieszka Banas; Raju Ramanujan (2011). Evidence of anti free volume creation during deformation induced nanocrystallization of Nd—Fe—B metallic glass. , 5(5-6), 169-171.

(Continued)

*Primary Examiner* — William D Hutton, Jr.
*Assistant Examiner* — Avi T Skaist
(74) *Attorney, Agent, or Firm* — Scott Richardson; C. Tumey Law Group PLLC

(57) ABSTRACT

In general, in one aspect, embodiments relate to an apparatus that includes a downhole tool, that includes one or more sealing elements that includes a bulk metallic glass (BMG) elastomer composite material.

14 Claims, 8 Drawing Sheets

(56) References Cited

OTHER PUBLICATIONS

Seo, J.H.; Kim, D.U.; Ju, W.T.; Nam, J.S.; Hong, S.H.; Sohn, S.B.; Song, S.M. (2006). [IEEE the 33rd IEEE International Conference on Plasma Science, 2006. ICOPS 2006. IEEE Conference Record—Abstracts.—Traverse City, MI, USA (Jun. 4, 2006-Jun. 8, 2006)] The 33rd IEEE International Conference on Plasma Science, 2006. ICOPS 2006. IEEE Conference Record—Abstracts.—RF thermal plasma treatment for size reduction and spheroidization of glass powders used in ceramic electronic devices. , ( ), 376-376.

Liang, Zhuofan; Yang, Lianzan; Li, Yongyan; Wang, Xi; Qin, Chunling; Zhao, Weimin; Yu, Hui; Wang, Zhifeng (2018). Effects of Ag, Nd, and Yb on the Microstructures and Mechanical Properties of Mg—Zn—Ca Metallic Glasses. Metals, 8 (10), 856–.

Zhao, Yan-feng; Zhu, Jian; Chang, Li; Song, Jing-guo; Chen, Xiao-hua; Hui, Xi-dong (2014). Influence of Cu content on the mechanical properties and corrosion resistance of Mg—Zn—Ca bulk metallic glasses. International Journal of Minerals, Metallurgy, and Materials, 21(5), 487-493.

V. Goodship, Arburg, Practical Guide to Injection Moulding, 2004.

B. Gun; K.J. Laws; M. Ferry (2006). Superplastic flow of a Mg-based bulk metallic glass in the supercooled liquid region. , 352(36-37), 0-3902.

S Mukherjee; J Schroers; Z Zhou; W.L Johnson; W.-K Rhim (2004). Viscosity and specific volume of bulk metallic glass-forming alloys and their correlation with glass forming ability. , 52(12), 3689-3695.

Sharma, et al., Polymers, Investigation of Thermal Properties of Zr-Based Metallic Glass-Polymer Composite with the Addition of Silane, 2022.

Shukla, S.; Wu, D.T.; Ramanarayan, H.; Srolovitz, D.; Ramanujan, R.V. (2013). Nanocrystallization in driven amorphous materials. Acta Materialia, 61(9), 3242-3248.

Greer, A. L.; Ma, E. (2007). Bulk Metallic Glasses: At the Cutting Edge of Metals Research. MRS Bulletin, 32(8), 611-619.

Indutherm, Gas Atomizer Aug 1000-25000, Available at http://www.indutherm.de/powder-production/aug-1000-25000/. Accessed Nov. 27, 2023.

Plastics, Extrusion Processing Guide: TPE—Thermoplastic Elastomers, 2015.

U.S. Appl. No. 18/228,135 dated Jul. 21, 2023.

U.S. Appl. No. 18/501,400 dated Nov. 3, 2023.

International Search Report and Written Opinion for International Patent Application No. PCT/US2023/084524 dated Aug. 9, 2024. PDF file. 8 pages.

* cited by examiner

BULK METALLIC GLASS REINFORCED ELASTOMER FOR DOWNHOLE APPLICATIONS

BACKGROUND

Boreholes may be drilled into subterranean formations to recover valuable hydrocarbons, among other functions. Operations may be performed before, during, and after the borehole has been drilled to produce and continue the flow of the hydrocarbon fluids from the subterranean formation through the borehole to the surface. Downhole tools in the borehole or wellbore may facilitate the production of the hydrocarbon fluids from the subterranean formation.

A typical operation concerning downhole applications may be to apply a seal within a borehole. A seal may isolate and contain produced hydrocarbons and pressures within the borehole. There may be a variety of different tools and equipment used to create seals between the outside of a production tubing string and the inside of a casing string, liner, or the wall of a wellbore.

Exposure to extreme conditions, such as high temperature high pressure (HTHP) conditions, degrades the material properties of elastomeric seals. For example, reduction in modulus, strength, and elongation of the types of seals may ultimately cause them to extrude through clearances when there exist large pressure differentials. Moreover, elevated temperatures may cause the elastomer seals to lose elongation and fracture, ultimately leading to failure (e.g., due to breaking or tearing). Conventional solutions to these problems include using reinforcing fillers (e.g., carbon black, silica, etc.). However, conventional fillers often have an adverse effect on elongation. Plasticizers are also sometimes used; however, plasticizers may leach out of the elastomer with time or temperature, leading to poorer mechanical properties.

BRIEF DESCRIPTION OF THE DRAWINGS

These drawings illustrate certain aspects of some of the embodiments of the present disclosure and should not be used to limit or define the disclosure.

DETAILED DESCRIPTION

Figure 1:
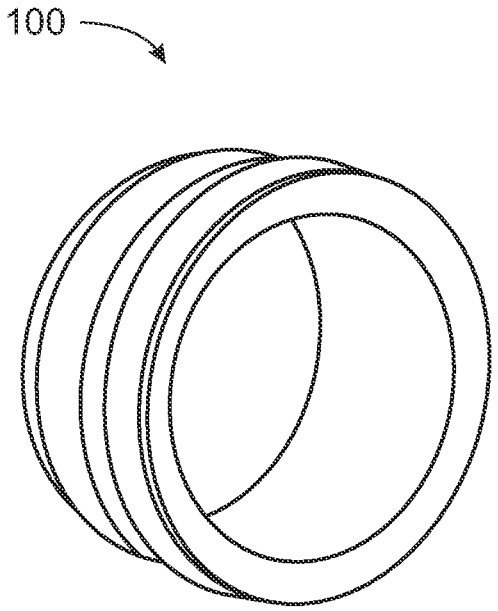
FIG. 1 is a diagram of a bulk metallic glass (BMG) reinforced elastomeric sealing element for a downhole tool in accordance with some embodiments of the present disclosure.

Disclosed herein are bulk metallic glass (BMG) reinforced elastomeric sealing elements that include a BMG-elastomer composite material. The BMG-elastomer composite material of the present disclosure exhibits good compatibility with high temperature high pressure (HTHP) conditions as well as good extrusion resistance. The sealing elements (seals) having the BMG-elastomer composite material may be for downhole tools, such as packers. Implementations herein of BMG-elastomer composite material for sealing elements may include BMG having an amorphous structure with no nanocrystalline phases. Also disclosed herein are methods of reinforcing an elastomer with BMG particles to form the BMG-elastomer composite material.

As alluded to above, HPHT conditions may cause rapid decline in the modulus (e.g., Young's modulus), strength (ability to withstand an applied load without failure or plastic deformation), and elongation (elongation at break) of conventional seals. Decrease in modulus and strength may cause conventional seals to extrude through the clearance when pressure differentials are relatively large. Reduction in elongation may cause the seal to fracture. Absorption of gases, such as hydrogen sulfide ($H_2S$), $H_2$, and $CO_2$, and supercritical $CO_2$ may lead to rapid gas decompression (RGD), which can fracture elastomeric seals. In some applications, exposure to gases is also accompanied with a relatively high service temperature, e.g., −80° C. in CCUS or greater than 175° C. in HPHT, accelerating the failure.

Further, seals (elastomeric seals) generally tend to swell when they interact with water or oil. Swelling results in changes in volume, thickness, density, hardness, and other mechanical properties, leading to reduced performance with time. Elastomeric seals can be sensitive to (attacked and degraded by) chemicals and generally cannot withstand abrasive or erosive media.

A challenge can be to design seals that do not measurably absorb gases, water, or oil, have relatively high resistance to abrasion and erosion, are generally not sensitive (or relatively low sensitivity) to chemicals, and maintain a specified (beneficial) modulus, strength, and elongation over a wide range of pressures and temperatures likely in downhole service conditions. In response, embodiments herein include seals comprising the BMG-elastomer composite material that address these functional and property issues.

BMGs, also known as metallic glass, amorphous metal, amorphous alloy, or glassy metal, are metal alloys having a disordered atomic-scale structure (glass-like) that is amorphous (non-crystalline) and exhibits electrical conductivity and metallic luster. BMGs are solid non-crystalline metallic alloys having strength, hardness, and elasticity. BMG-elastomer composite materials have good thermoplastic processability and remain elastic at elevated temperatures. As disclosed herein, the increased strength, modulus, and elongation of BMG-elastomer composite materials improves extrusion resistance while still maintaining high elasticity. Furthermore, BMG-elastomer composite materials have good retention of tensile properties at elevated temperatures due to their high thermal conductivity. Additionally, if the BMG-elastomer composite material is set at a temperature where BMG particles can flow superplastically, the high-temperature elongation of a seal comprising the material will improve, while also improving its strength and hardness after the seal is set.

BMG reinforcement may improve the performance of elastomers used in various downhole tools (e.g., packers, molded seals, O-rings, etc.), especially in extreme conditions such as where pressure differential exceeds 5000 psi (34.5 MPa) and/or temperature exceeds 250° F. (121° C.). In some examples, reinforcement of elastomers with BMG may preserve high-temperature elongation even where the elastomers have a high shore-A hardness. This allows the BMG-elastomer composite materials to meet the stringent expansion requirements of open-hole packer elements, such as packers used in off-bottom cementing (OBC) operations, i.e., OBC packers. In further examples, BMG reinforcement of elastomers may broaden their applicability to a greater number of downhole operations.

BMG can be produced, for example, by rapid cooling, physical vapor deposition, solid-state reaction, ion irradiation, and mechanical alloying. BMG may be considered true glasses in that BMG softens and flows upon heating, facilitating processing, such as by injection molding, similar to thermoplastic polymers. BMGs are tougher and less brittle than oxide glasses and ceramics. In some examples, BMG particles are produced by mechanical milling of rapidly solidified BMG rods or BMG ribbons, or thermoplastically formed BMG ingots.

BMGs can be a metal alloy, for example, of three or more of the following: zirconium (Zr), copper (Cu), silver (Ag), aluminum (Al), titanium (Ti), nickel (Ni), niobium (Nb), chromium (Cr), tantalum (Ta), beryllium (Be), magnesium (Mg), lanthanides (general symbol Ln), palladium (Pd), calcium (Ca), platinum (Pt), gold (Au), iron (Fe), cobalt (Co), yttrium (Y), hafnium (Hf), and lithium (Li). For a metal present in the BMG (alloy) at least 40 atomic percent (at %), the BMG may be labeled as based on that metal. For instance, a BMG having Mg at least 40 at % can be called an Mg-based BMG. Likewise, a BMG having Zr at least 40 at % can be called a Zr-based BMG. In examples, BMGs of the present disclosure may be based on Zr, Fe, Ni, Cu, Cr, Ti, Al, and their variants arising from different alloying additions.

Specific non-limiting examples of BMGs include, for example, MgCuY, MgZnCa, MgCuGd, CaMgCu, MgNiMn, AuCuSi, PdCuSi, TiZrNiCu, PdCuNiP, CaMgCu, LaAlCoCuNi, FeCoCrMoCBY, PtNiCuP, and any combinations thereof, as well as their variants arising from different alloying additions.

In some examples, different alloying additions may include one or more metalloids, such as boron (B), silicon (Si), carbon (C), phosphorus (P), etc., and any combinations thereof.

As mentioned, the structure of BMGs is amorphous and devoid of any nanocrystals in embodiments. In other embodiments, BMGs with nanocrystals in the range of 1 weight percent (wt %) to 10 wt % can be utilized to make the seal or the fillers for elastomeric seals.

As mentioned, BMGs are incorporated into one or more elastomers to form the BMG-elastomer composite material. This may be accomplished through shear mixing using a two-roll mill or an internal mixer, for example. In some examples, the BMG-elastomer composite material may be cured during a compression, transfer, or injection molding process. In some examples, the BMG-elastomer composite material is produced by mixing BMG and elastomer powder, shaping a powder blend by extrusion and/or moulding, e.g., at a specified temperature range where the BMG particles can flow superplastically, and optionally, curing the material with a bonding agent (e.g., silane).

The one or more BMGs may be incorporated into the one or more elastomers as a lone filler, or as a combination with other fillers such as carbon black, silica, clay, etc. Further, as mentioned above, a bonding agent such as silane may be included in the BMG-elastomer composite material to improve the bonding between the BMG and the elastomer during curing of the BMG-elastomer composite material. Other examples of bonding agents may include, without limitation, organometallic compounds, based on titanium, zirconium, or aluminium, for example.

Where a seal comprising the BMG-elastomer composite material is set at a temperature where BMG particles can flow superplastically, the high-temperature elongation of the seal will improve, while also improving its strength and hardness after the seal is set. Thus, the specific material(s) used in a BMG-elastomeric seal may be selected based on the compatibility between the superplastic properties of the BMG and the shaping temperature of one or more elastomers. For example, BMG(s) used in the BMG-elastomer composite material may flow superplastically at a temperature range similar (e.g., within 10° C., 25° C., or 50° C.) to a molding temperature, extrusion temperature, and/or shaping temperature of at least one elastomer used to form the BMG-elastomer composite material.

In some examples, superplastic flow of BMG particles may heal or prevent fractures in a seal, which may be attributable to the liquid-like mobility of BMG particles within the elastomeric matrix of the seal comprising the BMG-elastomer composite material. For example, the BMG particles may be in a mobile phase during cooling such that there is interfacial wetting between the mobile BMG phase and the one or more elastomers.

The volume and/or composition of the BMG-elastomer composite material may be tailored to ensure that a seal possesses the desirable properties. For example, a BMG-elastomer composite material may comprise at least three elements, with the major element being an alkaline earth metal and at least one minor element being a rare-earth metal. This may ensure the BMG-elastomer composite material has its glass transition temperature within a specific range (e.g., 140° C., or higher). In examples, BMG particles may be present within the BMG-elastomer composite material in an amount from about 20 wt. % to about 25 wt. %, about 25 wt. % to about 30 wt. %, about 30 wt. % to about 35 wt. %, about 35 wt. % to about 40 wt. %, and any ranges therebetween.

Suitable examples of elastomers used in the BMG-elastomer composite material may include thermoset elastomers. For example, nitrile rubbers, hydrogenated nitrile rubbers, fluoroelastomers (FKM), propylene tetrafluoroethylene, and perfluoroelastomers. Alternatively, or additionally, thermoplastic elastomers, thermoplastic rubbers, and/or plastomers, for example, materials which include both thermoplastic and elastomeric properties. These may include polyethylene, ethylene-propylene-diene rubber, ethylene octane copolymer (and other ethylene-based plastomer resins), linear low-density polyethylene (LLDPE), ultra-low density polyethylene (ULDPE), and any combinations thereof. Other examples of elastomers may include natural rubbers, styrene-butadiene block copolymers, polyisoprene, polybutadiene, ethylene propylene rubber, ethylene propylene diene rubber, silicone elastomers, polyurethane elastomers, and nitrile rubbers. In examples, the elastomer(s) may be individually or collectively present within the BMG-elastomer composite material in an amount from about 60 wt. % to about 65 wt. %, about 65 wt. % to about 70 wt. %, about 70 wt. % to about 75 wt. %, about 75 wt. % to about 80 wt. %, and any ranges therebetween.

Non-elastomeric materials may also be incorporated in the BMG-elastomer composite material, in some examples. Non-elastomeric material utilized for downhole seals or back-up rings may include polyphenylene sulfide (PPS), polyether ether ketone (PEEK), polytetrafluoroethylene (PTFE), and any combination thereof. For example, PTFE may be included in the BMG-elastomer composite material to improve friction reduction, in some examples. Other non-elastomeric materials may include nanofillers, for example, carbon nanotubes (CNT) or nanocrystalline metals (nanometal). In examples, non-elastomeric materials may be present within the BMG-elastomer composite material in an amount from about 1 wt. % to about 5 wt. %, about 5 wt. % to about 10 wt. %, about 10 wt. % to about 15 wt. %, about 15 wt. % to about 20 wt. %, and any ranges therebetween. In examples, nanofillers may be present within the BMG-elastomer composite material in an amount from about 1 wt. % to about 5 wt. %, and any ranges therebetween.

One or more seals comprising the BMG-elastomer composite material may be used at a variety of service temperatures at or above a BMG glass transition temperature of the one or more BMGs, which may induce supercooling of the BMG(s), for example, between 140° C. and 200° C.

Techniques for producing the BMG fillers used in the BMG-elastomer composite material may be based on, for example, rapid solidification that can be performed by melt-spinning, splat-quenching, micro-injection molding, suction casting, rapid discharge forming, superplastic forming, or any other similar technique that can solidify and shape the molten BMG without its crystallization.

In one example, a technique for setting a BMG seal may involve deformation at or above the glass transition point, so the BMG flows superplastically to fill and conform to the geometry of the annulus. With time, the BMG will generally set the seal and in implementations, may crystallize.

Implementations of the BMG-elastomer composite material seals (e.g., comprising Zr-based BMG) as disclosed herein have [1] high yield strength, e.g. higher than the single phase elastomer, but lower than about 2500 megapascals (MPa), and [2] high modulus of elasticity (Young's modulus), such as significantly higher than for the single phase elastomer, but lower than about 150 gigapascals (GPa), combined with [3] high fracture toughness, such as significantly higher than the single phase elastomer, but lower than about 150 MPa*meter$^{1/2}$ (MPa*m$^{1/2}$). As used herein, single phase elastomers have strength and modulus in the range of 10-30 MPa, and fracture toughness only around 1 MPa*m$^{1/2}$. As a result of improved crack resistance and load bearing capability, once the BMG-elastomer composite material seal is set and installed downhole, it may withstand relatively large pressure differentials without extruding through the clearance. Additionally, after the seal is set, exposure to high temperature (e.g., greater than 300° C., or in the range of 300° C. to 500° C.) or low temperature (e.g., less than −190° C., or in the range of −300° C. to −190° C.) generally does not cause the BMC reinforced elastomeric seal to crack in implementations herein. Conversely, conventional elastomeric seals fracture at such temperatures. Further, seals made of BMGs generally not absorb water, oil, or gases and will experience little or no RGD damage. Elastomeric seals typically cannot offer a comparable fluid resistance. BMG seals can resist damage due to formation fluids and offer orders of magnitude higher resistance to abrasion and erosion, compared to conventional seals.

For BMGs (e.g., Zr-based BMGs), their strength beneficially combines with their elastic modulus that considerably exceeds the modulus of elastomers. Additionally, at certain elevated temperatures, BMGs can flow like a viscous fluid making the BMGs processable, similar to thermoplastics. Elastomers do not offer a comparable formability unless a thermoplastic filler is added to the elastomeric matrix. Another implication of the non-crystalline BMG superplastic-like behavior is giving significant high-temperature elongation. This behavior of BMGs can be harnessed to deform the seal and make the seal conform to the desired geometry during setting.

The BMG seal can be set when it is in a supercooled state between its glass transition and crystallization temperature. After setting, it can be used at any service temperature that falls below its glass transition temperature (e.g., at least 300° C.) down to the cryogenic range (e.g., −150° C.).

FIG. 1 is a sealing element 100 that can be or include the BMG-elastomer composite material for a downhole tool (e.g., packer) in accordance with some examples of the present disclosure. As illustrated, the sealing element 100 may comprise a body which may be concentrically disposed about a tubular or tubular members.

Figure 2:
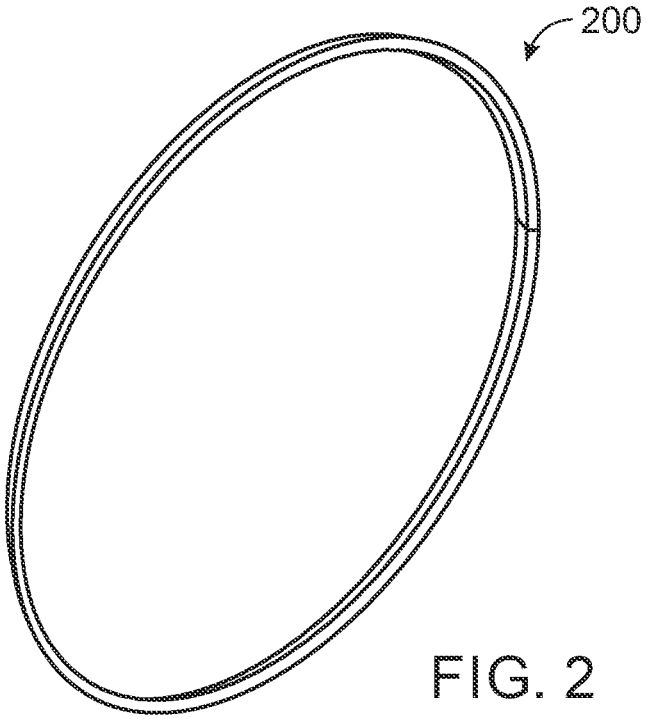
FIG. 2 is a diagram of an O-ring that can include or be BMG-elastomer composite material for a downhole tool in accordance with some embodiments of the present disclosure.

FIG. 2 is an O-ring 200. The O-ring 200 can be disposed on a mandrel (tool mandrel) of a downhole tool, such as a packer, to be disposed in a wellbore. The O-ring 200 can be or include the BMG-elastomer composite material. Applications of the BMG-elastomer composite material may include seals, seal stacks, O-rings, anti-extrusion ring or backup (e.g., packer element backup), and so on, for downhole tools, such as packers. In examples, inclusion of the BMG-elastomer composite material in a seal (e.g., O-ring 200) may improve resistance to fluid absorption and RGD.

Figure 3:
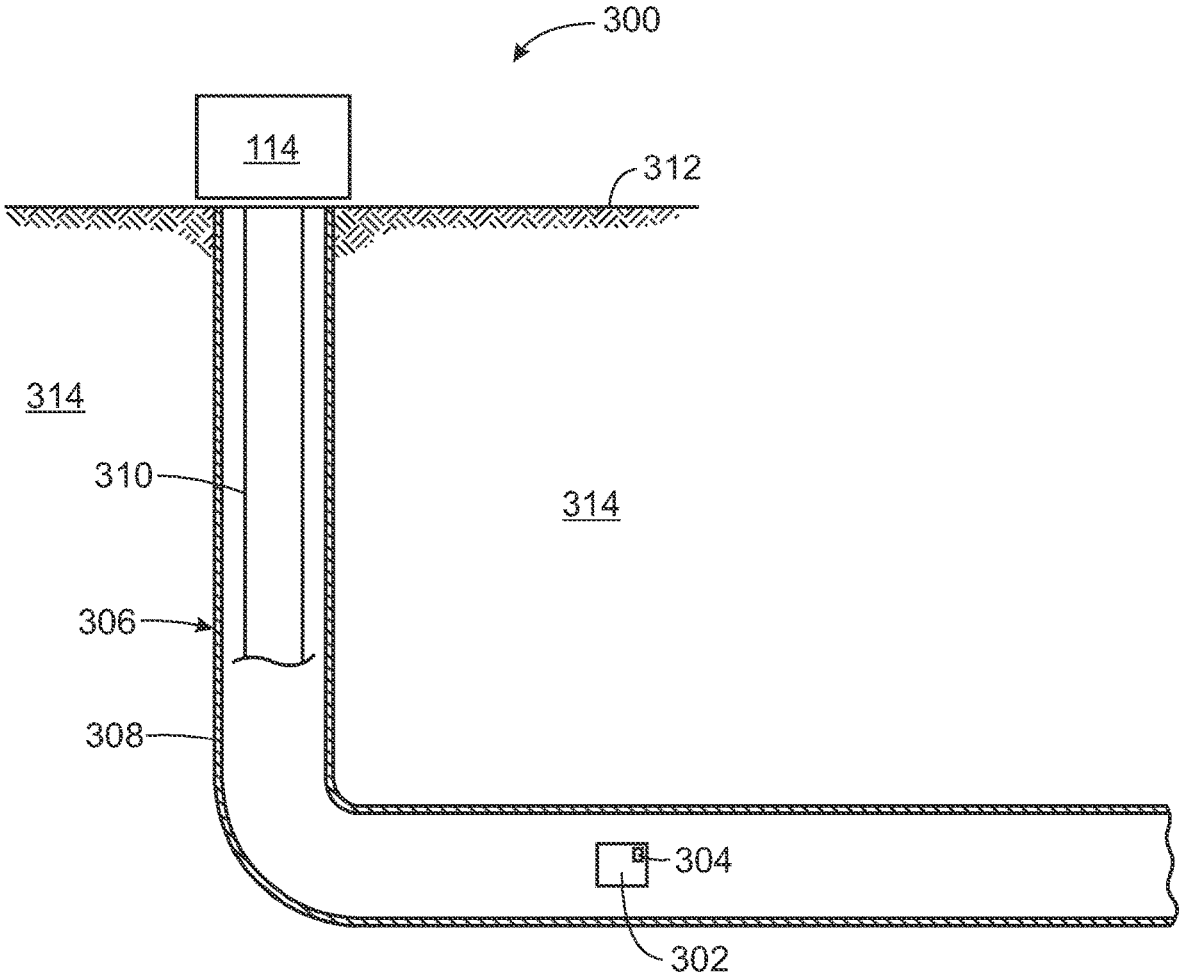
FIG. 3 is a diagram of a well site employing a downhole tool having a BMG-elastomer composite material component in accordance with some embodiments of the present disclosure.

FIG. 3 is a well site 300 employing a downhole tool 302 having a BMG-elastomer composite material 304, as discussed. The downhole tool 302 is depicted as the simplified representation of a square for clarity. The downhole tool 302 is deployed in a wellbore 306.

The BMG-elastomer composite material 304 may be a sealing element, an O-ring, a molded seal, etc., of the downhole tool 302. A sealing element as the BMG-elastomer composite material 304 may be utilized via the downhole tool 302 in operation, for example, to form a seal between the downhole tool 302 and an adjacent surface, such as a wellbore casing or liner. Other types of sealing elements are applicable. An O-ring and/or molded seal can be considered a sealing element.

The downhole tool 302 may be, for example, a packer (e.g., production packer, test packer, isolation packer, etc.), a plug (e.g., bridge plug, frac plug, ICD plug, etc.), a liner hanger (e.g., expandable liner hanger), a rotating control device (RCD), a valve, and the like. A valve as the downhole tool 302 (or as a part of a downhole tool 302) may include a BMG-elastomer composite material 304, for example, as a molded seal or O-ring.

The downhole tool 302 as installed in the wellbore 306 may be set permanently or set as retrievable. The downhole tool 302 may be mechanically set or hydraulically set.

When set, the downhole tool 302 if a packer or plug with the BMG-elastomer composite material 304 as a sealing element may fluidically isolate the lower part of the wellbore 306 (downhole of the packer or plug) from an upper part of the wellbore 306 (uphole of the packer or plug). When set, the downhole tool 302 as a packer may isolate zones of the annulus between the depicted casing 308 and production tubing 310 (e.g., a tubing string) by providing a seal (fluid seal) via the BMG-elastomer composite material 304 between the production tubing 310 and the casing 308. In examples, a packer if the downhole tool 302 may be disposed on the production tubing 310.

Where downhole tool 302 is a liner hanger, for example, the liner hanger may be deployed to mechanically support an upper end of a liner from the lower end of a previously installed casing. Additionally, liner hangers may be used to seal the liner to the casing 308, such as via the BMG-elastomer composite material 304 as a sealing element. Once an upper portion of the wellbore 306 has been drilled and cased, it may be desirable to continue drilling and to line a lower portion of the wellbore 306 with a liner lowered through the upper cased portion thereof. For the annulus between the liner hanger (e.g., expandable liner hanger) and the wellbore casing 308, the fluid seal may provide that in the annulus, uphole of the expandable liner hanger is fluidically sealed from downhole of the expandable liner hanger. The expandable liner hanger via the BMG-elastomer composite material 304 may create (provide) a hydraulic seal (fluid seal) between the expandable liner hanger and the wellbore casing 308.

The wellbore 306 is formed through the Earth surface 312 into a subterranean formation 314 in the Earth crust. In the illustrated implementation, the wellbore 306 has the casing 308 and is therefore a cased wellbore. Cement (not shown) may be disposed between the casing 308 and the formation 314 face. The formation 314 face can be considered a wall of the wellbore 306.

Perforations may be formed through the casing 308 (and cement) for entry of fluid (e.g., hydrocarbon, water, etc.) from the subterranean formation 314 into the wellbore 306 to be produced (routed) as produced fluid through the production tubing 310 to the surface 312. The surface equipment 316 situated at or near the wellbore 306 may include a wellhead for receipt of the produced fluid. In other implementations, the wellbore 306 can be utilized for injection of fluid from the surface 312 through the wellbore 306 and the perforations in the casing 308 (and cement) into the subterranean formation 314.

The surface equipment 316 can include a hoisting apparatus (e.g., for raising and lowering pipe strings) and a derrick. The surface equipment 316 and equipment deployed in the wellbore 306 can include a wireline, slickline, coiled tubing, tubing string, pipe, drill pipe, drill string, and the like, that facilitates mechanical conveyance for deploying downhole tools (e.g., downhole tool 302 and other tools). The deployment of the downhole tool 302 may include lowering the downhole tool 302 into the wellbore 306 from the surface 312 and setting (e.g., via mechanical slips or other mechanisms) the downhole tool 302 in the wellbore 306. In some implementations, the equipment (e.g., wireline) may provide electrical connectivity, for example, to actuate the downhole tool 302. For example, a packer or plug may be actuated to seal off a portion of the wellbore 306.

Again, the casing 308 may be secured within wellbore 306 by cement (not shown). The casing 308 may be, for example, metal, plastic, composites, and the like, and may be expanded or unexpanded as part of an installation procedure.

The production tubing 310 may be a tubing string utilized in the production of hydrocarbons. The downhole tool 302 may be disposed on or near production tubing 310 in certain implementations.

As mentioned, the downhole tool 302 as a plug (e.g., frac plug, bridge plug, etc.) having the BMG-elastomer composite material 304 as a sealing element may be set to isolate a lower part of the wellbore 306. The bridge plug may be installed to permanently seal the wellbore 306 or installed temporarily to perform work on or via the wellbore 306. Bridge plugs are downhole tools that can be located in the wellbore 306 and set to isolate the lower part of the wellbore 306 (further downhole). The bridge plug is generally run in hole and set to isolate a lower zone of the wellbore 306 from an upper zone of the wellbore 306. Bridge plugs may be permanent or retrievable, facilitating the lower wellbore to be permanently sealed from production or temporarily isolated from a treatment conducted on an upper zone of the wellbore 306.

A bridge plug can include slips (e.g., mechanical slips), a mandrel, and sealing element (e.g., expandable, elastomer, rubber, etc.). Again, the downhole tool as a bridge plug can be or include the sealing element having the BMG-elastomer composite material 302 previously discussed. A bridge plug may be run (e.g., run on a wireline or pipes, and/or through a tubing string) and set (e.g., set in casing 308 or tubing 310) to isolate a lower zone of the wellbore 306 while an upper section of the wellbore 306 is tested, cemented, stimulated (e.g., hydraulically fracturing of the subterranean formation 314), produced (e.g., hydrocarbon and/or water produced from the subterranean formation 314 through the wellbore 306), or injected (injection from surface 312 through the wellbore 306 into the subterranean formation 314). The bridge plug may isolate the upper zone from the lower zone, preventing or reducing fluids of the lower zone (downhole of the plug) from reaching an upper zone (uphole of the plug) of the wellbore 306. Again, such isolation may exist while the upper zone (section) is tested, cemented, stimulated, produced, or injected either permanently or temporarily within the wellbore 306.

The downhole tool 302 as a packer may be a device that can be run into the wellbore 306 with a smaller initial outside diameter that then expands externally to seal the wellbore 306. Packers may employ flexible, elastomeric elements (e.g., the BMG-elastomer composite material 302) that expand. The BMG-elastomer composite material expands, in some example, at service temperatures between 140° C. and 200° C., such as for an alkaline-earth rare-earth based BMG, e.g., MgCuY. A packer may be a production packer, test packer, isolation packer, etc. A production packer may isolate the annulus (e.g., between the production tubing 310 and the casing wellbore 102 wall) and anchor or secure the bottom of the production tubing string. A retrievable packer may be a type of packer that is run and retrieved on a running string or production string, unlike a permanent production packer that is set in the casing or liner before the production string is run. A typical packer assembly secures the packer against the casing 104 or liner wall, such as by a slip arrangement of the packer, and creates (forms) a hydraulic seal via sealing elements (e.g., BMG-elastomer composite material 302) of the packer to isolate the annulus. Packers are typically classified by application, setting method and possible retrievability.

Applicable wellbores for the downhole tool 302 and its BMG-elastomer composite material 304 include vertical wellbores, horizontal wellbores, deviated wellbores, multilateral wells, and the like. It should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. Also, even though FIG. 3 depicts an onshore operation, it should be understood by those skilled in the art that the present techniques are applicable for offshore operations. In addition, while FIG. 3 depicts use of the downhole tool 302 in a cased portion of wellbore 306, it should be understood that a downhole tool 302 may also be used in uncased portions (e.g., openhole portions) of wellbore 306.

An embodiment is a method of deploying a downhole tool (e.g., a packer, a plug, a liner hanger, etc.) into a wellbore. The method includes lowering the downhole tool into the wellbore and positioning the downhole tool at a target location (e.g., depth) in the wellbore. The downhole tool has a BMG-elastomer composite material. In implementations, the BMG-elastomer composite material is an O-ring or a molded seal. In implementations, the BMG-elastomer composite material is a sealing element. In those implementations, the method includes forming, via the sealing element, a seal (fluidic seal, hydraulic seal) between the downhole tool and a surface (e.g., a casing, a liner, a wellbore wall, etc.).

Figure 4A:
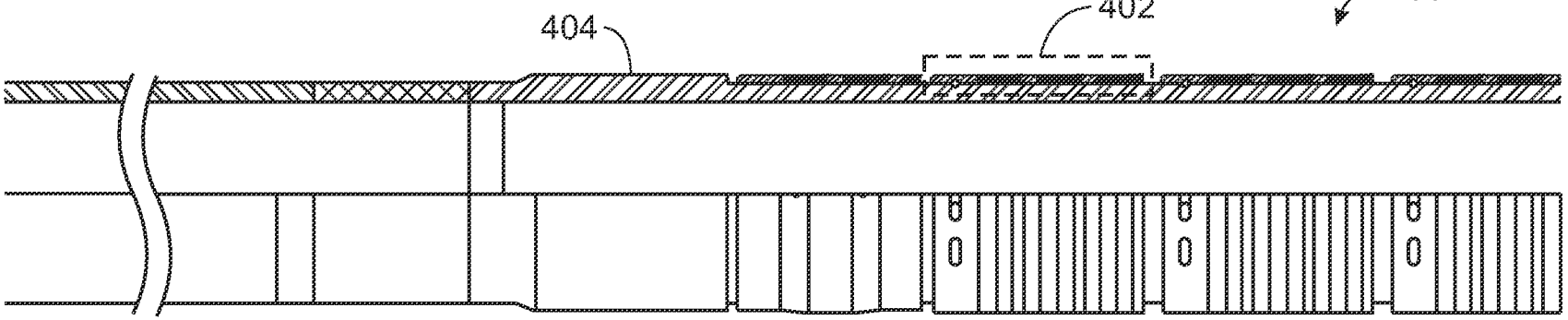
FIG. 4A is a diagram of downhole tool for a wellbore in accordance with some embodiments of the present disclosure.

FIG. 4A is a downhole tool 400 for a borehole (e.g., wellbore 306 of FIG. 3). The downhole tool 400 includes a seal stack 402 on a mandrel 404 (tool mandrel). The downhole tool 400 may be, for instance, a packer (e.g., production packer, isolation packer, etc.) to be installed in the wellbore.

The seal stack 402 includes the BMG-elastomer composite material design as discussed. A seal stack generally has multiple seals with different respective materials to give different properties. In examples, the seal stack 402 provides for a fluid seal in the wellbore between the seal stack 402 and the wellbore wall, thereby isolating (e.g., the annulus) downhole of the downhole tool 400 from uphole of the downhole tool 400.

Figure 4B:
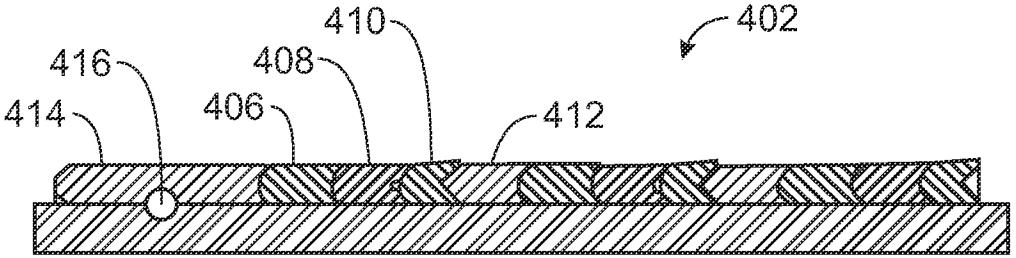
FIG. 4B is a diagram of a seal stack of the downhole tool of FIG. 4A in accordance with some embodiments of the present disclosure.

FIG. 4B is the seal stack 402 on the mandrel 404. FIG. 4B is an exploded view of the noted portion of FIG. 4A. The seal stack 402 includes seals 406, 408, 410 (e.g., rings) and spacer 412 (e.g., ring). The seals 406, 408, 410 (e.g., elastomeric) may be sealing elements that provide for a fluid seal in the wellbore between the mandrel 404 and the wellbore wall (e.g., casing). At least one of the seals 406, 408, 410 can be the aforementioned BMG-elastomer composite material. The seal stack 402 includes an end portion 414 and an O-ring 416. In implementations, the O-ring 416 includes the discussed BMG-elastomer composite material.

Figure 5:
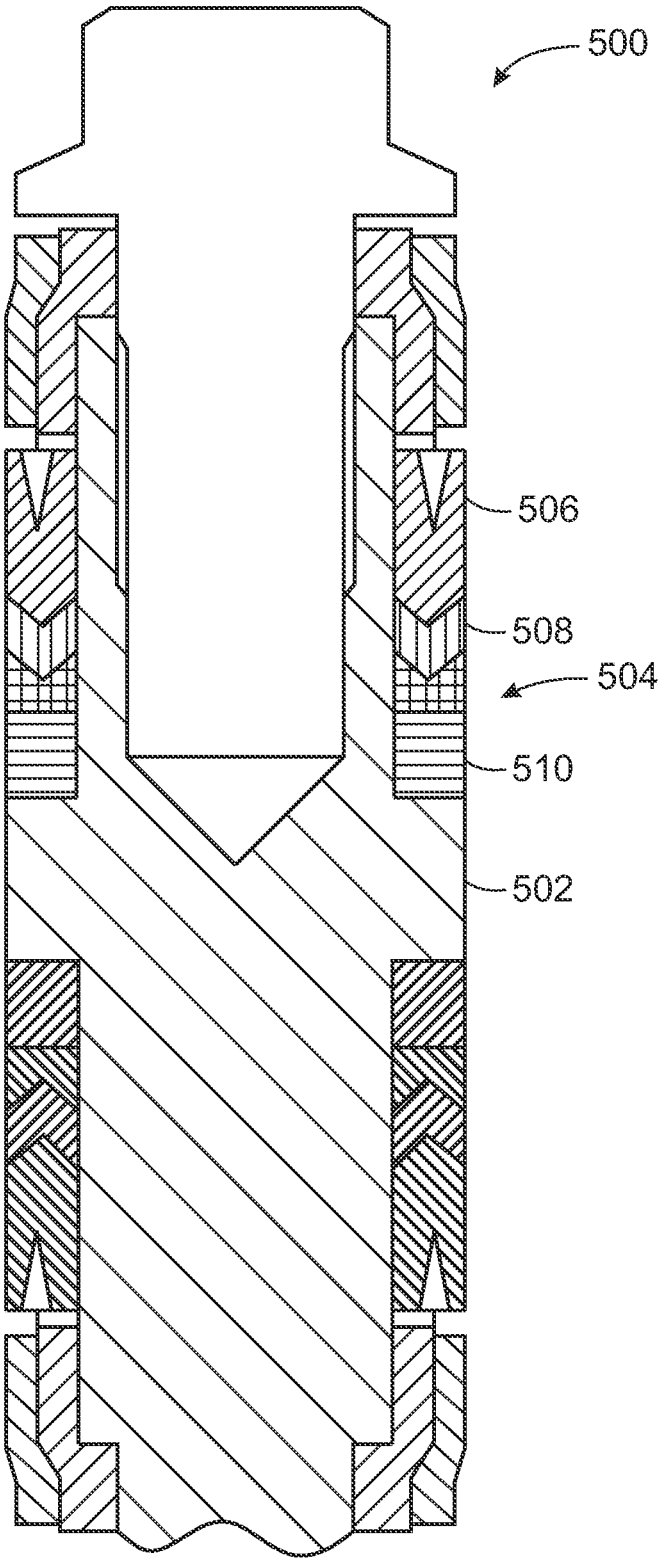
FIG. 5 is a diagram of a downhole tool to be disposed in a borehole in accordance with some embodiments of the present disclosure.

FIG. 5 is a downhole tool 500 to be disposed in a borehole (e.g., wellbore 306 of FIG. 3). The downhole tool 500 (e.g., packer) as installed in the wellbore may be permanently set or retrievable, mechanically set, hydraulically set, and/or combinations thereof. A retrievable packer may be a type of packer that is run and retrieved on a running string or production string, unlike a permanent production packer that is set in the casing or liner before the production string is run.

As discussed, a packer may be a device that can be run into a wellbore with a smaller initial outside diameter that then expands externally to seal the wellbore. Packers may include the BMG-elastomer composite material as presently disclosed. A packer may be a production packer, test packer, isolation packer, etc. A production packer may isolate the annulus (e.g., between the production tubing and the wellbore wall) and anchor or secure the bottom of the production tubing string. A typical packer assembly incorporates a means of securing the packer against the casing or liner wall, such as a slip arrangement, and a means (e.g., sealing elements) of creating a reliable hydraulic seal to isolate the annulus, typically by means of an expandable elastomeric element. Packers are typically classified by application, setting method and possible retrievability.

The downhole tool 500 (e.g., packer) may include a mandrel 502 (tool mandrel) and a seal stack 504 disposed about the mandrel 502. The seal stack 504 may be an assembly of individual sealing elements 506, 508, 510 utilized to seal off a portion of wellbore. One or more of the sealing elements 506, 508, 510 be or comprise the BMG-elastomer composite material.

As in the illustrated implementation, the individual sealing elements 506, 508, 510, within seal stack 504 may be of differing size, height, and/or shape. Without limitation, a shape may include, for example, cross-sectional shapes that are circular, elliptical, triangular, rectangular, square, hexagonal, irregular, and/or combinations thereof. The material selection for the sealing elements may be to tailor properties of the sealing elements 506, 508, 510, such as hardness, elasticity, gas resistance, chemical resistance, temperature resistance, and high temperature strength, among others.

Figure 6A:
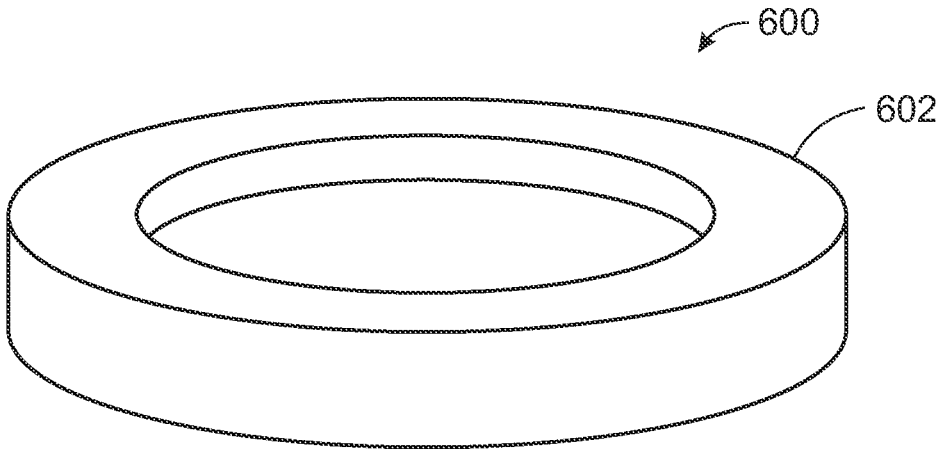
FIG. 6A is a diagram of a seal or sealing element that can include or be BMG-elastomer composite material in accordance with some embodiments of the present disclosure.
Figure 6B:
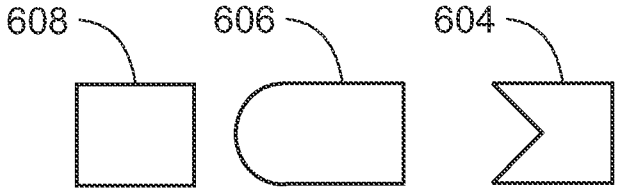
FIG. 6B is a diagram showing two-dimensional cross sections of one example the sealing element of FIG. 6A in accordance with some embodiments of the present disclosure.

FIG. 6A is a seal or sealing element 600 that can be or include the present BMG-elastomer composite material. The sealing element 600 is for a downhole tool, such as packer, plug, liner hanger, etc. As depicted, the sealing element 600 may have a generally annular body 602 (e.g., ring-shaped, comprising a ring shape to be situated around a tool mandrel). In some embodiments, the annular body 602 may be circular and/or hollow. In examples, the sealing element 600 may be configured with cross-sectional shapes. For instance, FIG. 6B shows how the sealing element 600 may have a cross-section similar in shape to V-shape 604, D-shape 606, square 608, an irregular shape, and/or combinations thereof.

Figure 7:
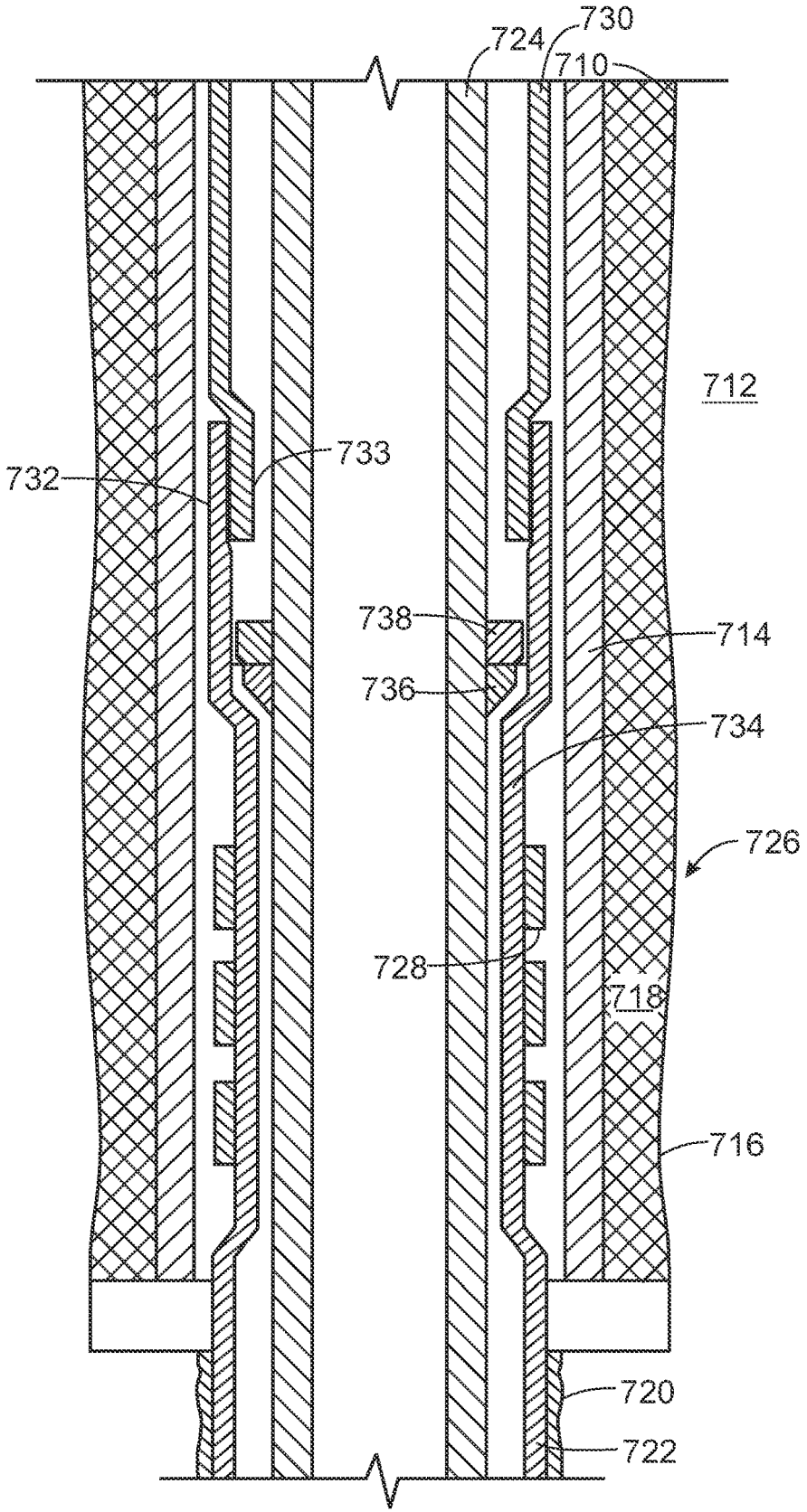
FIG. 7 is a diagram of an expandable liner hanger (ELH) that can incorporate seals (sealing elements) that can include or be BMG-elastomer composite material in accordance with some embodiments of the present disclosure.

FIG. 7 depicts an expandable liner hanger (ELH) that can incorporate seals (sealing elements) fabricated to be or include the BMG-elastomer composite material, as discussed herein. An ELH can be characterized as a downhole tool in being a cementing tool. Cement may be employed (injected) to install (secure) casing in a wellbore and prevent migration of fluids in the annulus between the casing and the wellbore wall.

ELHs typically utilize elastomeric rings (e.g., rings made of rubber) as seals or sealing elements carried on a section of expandable tubing to provide both mechanical support and a fluid seal. Here, at least one elastomeric ring can be or include the BMG-elastomer composite material.

Once an ELH is placed at a desired position downhole within a wellbore casing, an expansion cone may be forced through the ELH. The expansion cone expands the elastomeric rings of the ELH, bringing the rings (seals) into contact with the casing to provide both mechanical support and a fluid seal between the casing and a liner.

As shown in FIG. 7, a borehole as wellbore 710 may be drilled through the Earth surface into a subterranean formation in the Earth crust. A casing 714 may be placed in an upper portion 716 of the wellbore 710 and held in place by cement 718 that is injected between the casing 714 and the upper portion 716 of wellbore 710 wall (formation 712 face in this example). Once the casing 714 is installed, the casing 714 can be considered the wellbore 710 wall of the upper portion 716. With the casing 714 installed, the upper portion 716 may be called a cased borehole or cased wellbore. The inner (inside diameter) surface of the casing 714 may be considered the inner surface (inside diameter) of the wellbore 710 in the upper portion 716.

Below the casing 714, a borehole as a lower portion 720 of the wellbore 710 may be drilled through casing 714. The lower portion 720 may have a smaller diameter than the upper portion 716. A length of liner 722 is shown positioned within the lower portion 720. The liner 722 may line or case the lower portion 720 and/or be utilized to drill the lower portion 720. If desired, cement 718 may be placed between the liner 722 and the lower portion 720 of wellbore 710. The cement 718 may be placed between the liner 722 and the wellbore 710 wall or formation 712 face of the wellbore 710. The liner 722 may be installed in the wellbore 710 via (by means of) a work string 724. The work string 724 may include a releasable collet (not shown) by which the work string 724 can support and rotate the liner 722 as it is placed in the wellbore 710.

Attached to the upper end of (or formed as an integral part of) the liner 722 is a liner hanger 726 which may include a number of annular seals 728 (sealing elements). One or more of the seals 728 may include or be the BMG-elastomer composite material.

In operation, the seals 728 may form a seal with the inside surface of the casing 714 as an adjacent surface. While three seals 728 are depicted for illustrative purposes, any number of seals 728 may be used. A polished bore receptacle 730 (or tie back receptacle) may be coupled to the upper end of the liner hanger 726. In one embodiment, the polished bore receptacle 730 may be coupled to the liner hanger 726 by a threaded joint 732, but in other embodiments a different coupling mechanism may be employed. The inner bore of the polished bore receptacle 730 may be smooth and machined to close tolerance to permit work strings, production tubing, etc., to be connected to the liner 722 in a fluid-tight and pressure-tight manner. For instance, a work string may be connected by means of the polished bore receptacle 730 and used to pump fracturing fluid at high pressure down to the lower portion 720 of the wellbore 710 without exposing the casing 714 to the fracturing pressure.

It may be desirable that the outer diameter of liner 722 be as large as possible while being able to lower the liner 722 through the casing 714. It may also be desirable that the outer diameter of the polished bore receptacle 730 and the liner hanger 726 be about the same as the diameter of liner 722. In the run-in-hole (RIH) configuration, the outer diameter of liner hanger 726 is defined by the outer diameter of the annular seals 728. In the RIH configuration, a body or mandrel 734 of liner hanger 726 has an outer diameter reduced by about the thickness of the seals 728 so that the outer diameter of the seals is about the same as the outer diameter of liner 722 and tie back receptacle 730.

In this implementation, first and second expansion cones 736 and 738 may be carried on the work string 724 just above the reduced diameter body 734 of the liner hanger 726. Fluid pressure applied between the work string 724 and the liner hanger 726 may be used to drive the cones 736, 738 downward through the liner hanger 726 to expand the body 734 to an outer diameter at which the seals 728 are forced into sealing and supporting contact with the casing 714. The first expansion cone 736 may be a solid, or fixed diameter, cone having a fixed outer diameter smaller than the inner diameter 733 of the threaded joint 732. In the RIH configuration, second expansion cone 38 may have an outer diameter greater than first cone 736 and also greater than the inner diameter 733 of the threaded joint 732. In an embodiment, the second expansion cone 738 may be collapsible, that is, may be reduced in diameter smaller than the inner diameter 733 of the threaded joint 732 when it needs to be withdrawn from the liner hanger 726. In some contexts, the second expansion cone 738 may be referred to as a collapsible expansion cone. After the liner hanger 726 is expanded, expansion cones 736, 738 may be withdrawn from the liner hanger 726, through the polished bore receptacle 730 and out of the wellbore 710 with the work string 724.

Figure 8:
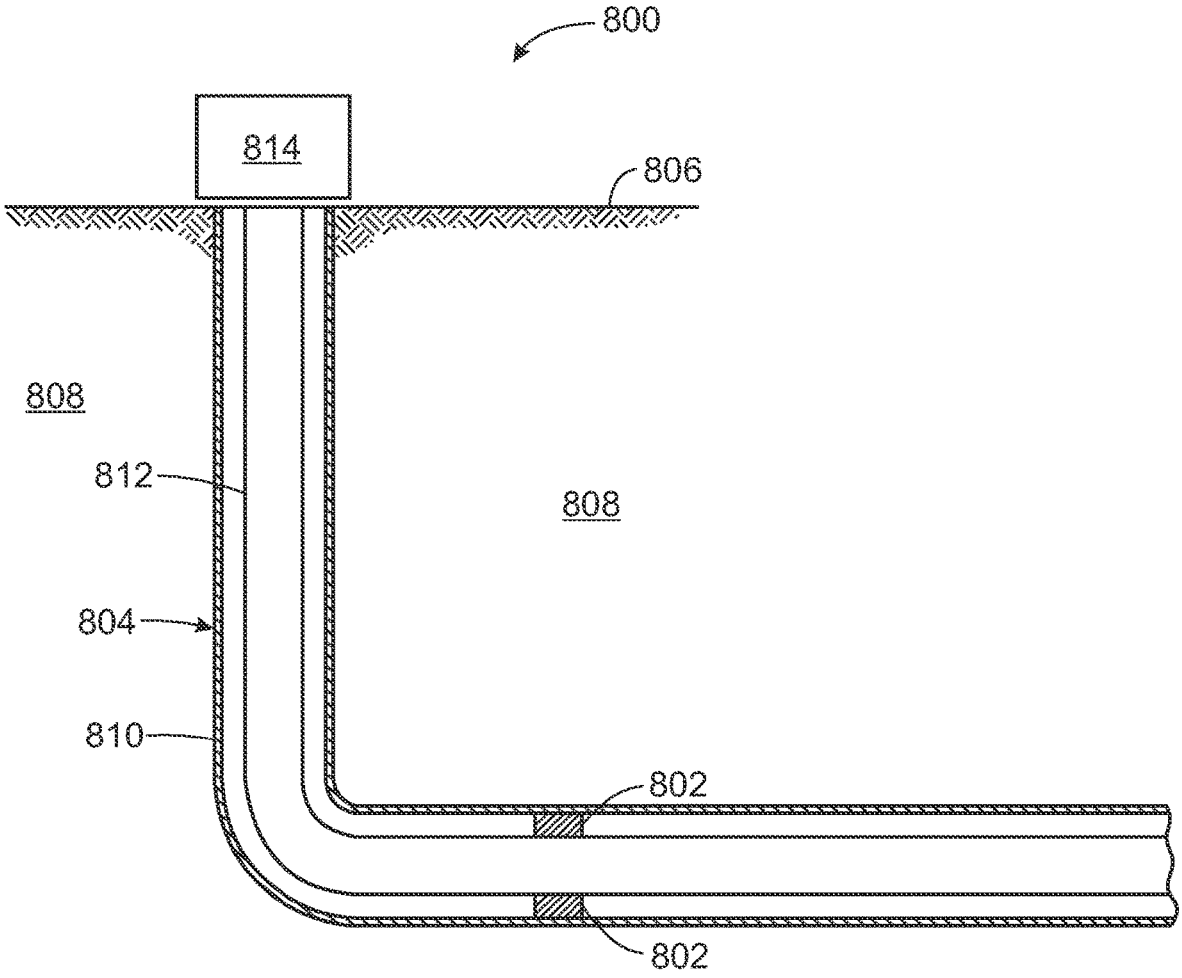
FIG. 8 is a diagram of a well site that includes a packer in a wellbore in accordance with some embodiments of the present disclosure.

FIG. 8 is a well site 800 that includes a packer 802 in a wellbore 804. The packer 802 has a seal (sealing element) that may include or be the BMG-elastomer composite material, as discussed. Depending on the type of packer 802, the packer 802 may be permanently set or retrievable, mechanically set, hydraulically set, and/or combinations thereof. The packer 802 may include one or more sealing elements, such as those shown by any of FIGS. 1 and 2, seals 406, 408, 410 of FIG. 4B, and sealing elements 506, 508, 510 of FIG. 5, etc. The packer 802 may be set downhole to seal off a portion of the wellbore 804.

The wellbore 804 is formed through the Earth surface 806 into a subterranean formation 808. In the illustrated implementation, the wellbore 804 has a casing 810 and is therefore a cased wellbore. In operation, fluid (e.g., hydrocarbon, water, etc.) may be produced from the subterranean formation 808 through the wellbore 804 as produced fluid through production tubing 812 to the surface 806. The surface equipment 814 (e.g., analogous to surface equipment 314 of FIG. 3) may include a wellhead for receipt of the produced fluid. The production tubing 812 may be a tubing string utilized in the production of hydrocarbons. The packer 802 may be disposed on or near production tubing 812. When set, the packer 802 may isolate zones of the annulus between casing 810 and the production tubing 812 (e.g., a tubing string) by providing a seal (fluid seal) between the production tubing 812 and the casing 810. While FIG. 8 depicts use of the packer 802 in a cased portion of the wellbore 804, a packer 802 may also be used in uncased portions (e.g., openhole portions) of a wellbore 804.

Figure 9:
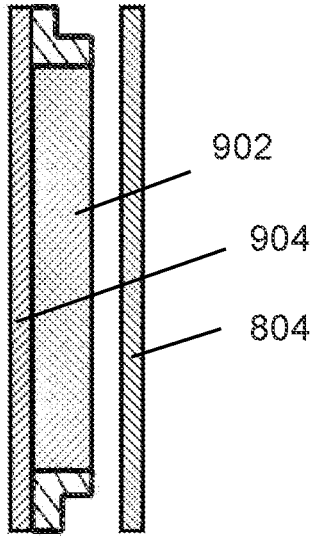
FIG. 9 is an example packer element that can include or be BMG-elastomer composite material concentrically disposed in a wellbore in an uncompressed configuration in accordance with some embodiments of the present disclosure.

FIG. 9 is an example packer element 902 that can include or be BMG-elastomer composite material concentrically disposed in a wellbore 804 about a member 904 of a downhole tool (e.g., packer) and in an uncompressed configuration in accordance with some embodiments of the present disclosure. As illustrated, a packer element 902 does not sealingly engage the walls of the wellbore 804 while in the uncompressed configuration, such as when the tool is being run to a target depth in a run-in-hole (RIH) configuration.

Figure 10:
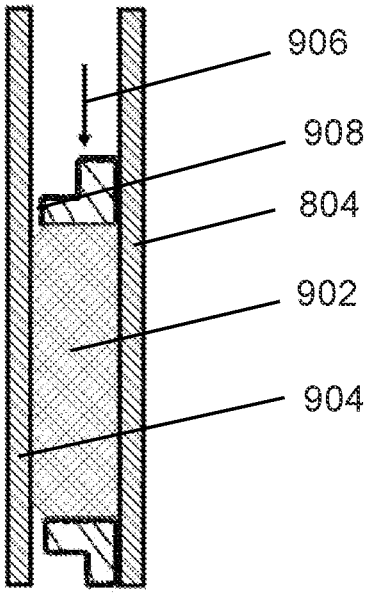
FIG. 10 is the example packer element of FIG. 9 in a compressed configuration in accordance with some embodiments of the present disclosure.

FIG. 10 is the example packer element 902 of FIG. 9, but in a compressed configuration in accordance with some embodiments of the present disclosure. The arrow indicated by 906 represents a downward force applied to the tool that causes the packer element 902 to flare outwards to sealingly engage the wall of the wellbore 804 and a surface of the member 904, thereby disallowing fluid communication between regions above and below the packer element 902. As alluded to, advantageously, the material properties of the BMG-elastomer composite material may prevent or mitigate extrusion of the packer element 902 through clearance 908 when the downward force at 906 is applied to the packer element 902. While the downward force 906 is shown as being applied in the downhole direction, it should be understood that alternative arrangements are possible, such as when force is alternatively, or additionally, applied in an uphole direction on packer element 902.

An example technique for forming the BMG-elastomer composite material of the present disclosure is provided. In this example, one or more BMG fillers are produced by vacuum induction melting followed by gas atomization. A pre-alloyed feedstock for atomization is prepared in a plasma arc melter, where the feedstock is melted in a vacuum induction furnace at a high temperature (e.g., 1320° C.). High pressure inert gas is used to atomize and rapidly solidify the molten alloy with a cooling rate, such as between $10^5$ K/s to $10^6$ K/s, or any ranges therebetween, for example. However, BMG filler particles may be produced by alternative atomization processes, for example, water atomization, centrifugal atomization, etc. Following solidification, powders produced by gas atomization may be subjected to a plasma spheroidization process to obtain sub-micron size BMG fillers. This may involve ball-milling the rapidly solidified material under an inert environment to produce the sub-micron size BMG fillers. Different microstructures (e.g., fully, or partially amorphous) of the BMG can be produced during rapid solidification by adjusting processing parameters, which may be used to tailor the strength, modulus, and superplasticity of a seal comprising the BMG-elastomer composite material. Processing parameters to be adjusted may include, for example, solidification rate, which determines whether the BMG is fully or partially amorphous, which may have an effect on the macroscopic properties (e.g., strength, modulus, superplasticity, etc.) of the BMG-elastomer composite material. As discussed, in some examples, a BMG filler may be completely amorphous, or essentially completely amorphous which may be confirmed using transmission electron microscopy (TEM). BMG filler comprises one or more BMG powders, which may have different microstructures. By adjusting the characteristic properties of the one or more BMGs, the specific properties (e.g., strength, modulus, superplasticity, etc.) of the BMG-elastomer composite material may be tailored to suit a particular downhole application. Following the spheroidization process, the BMG-elastomer composite material is produced by mixing the one or more BMG powders and elastomer powder to form a powder blend, and then shaping the powder blend, e.g., by extrusion or moulding at a temperature where the BMG particles can flow superplastically. Optionally, this is followed by curing of the BMG-elastomer composite material with a bonding agent (e.g., silane).

In view of the foregoing, the present disclosure may provide a downhole tool a BMG-elastomer composite material with improved compatibility for HTHP conditions. The methods, systems, and tools may include any of the various features disclosed herein, including one or more of the following statements.

Statement 1: An apparatus comprising: a downhole tool, comprising: one or more sealing elements comprising a bulk metallic glass (BMG) elastomer composite material.

Statement 2: The apparatus of statement 1, wherein the BMG elastomer composite material comprises an alkaline-earth rare-earth based BMG.

Statement 3: The apparatus of statement 2, wherein the alkaline-earth rare-earth based BMG comprises MgCuY in an amount from about 20 wt. % to about 40 wt. %.

Statement 4: The apparatus of any of statements 1-3, wherein thermoplastic is present in the BMG elastomer composite material in an amount from about 10 wt. % to about 20 wt. %.

Statement 5: The apparatus of any of statements 1-4, wherein the BMG elastomer composite material comprises at least one BMG selected from the group consisting of an MG-based BMG, a Zr-based BMG, a Fe-based BMG, a Ni-based BMG, a Cu-based BMG, a Cr-based BMG, a Ti-based BMG, an Al-based BMG, and any combination thereof.

Statement 6: The apparatus of any of statements 1-4, wherein the BMG elastomer composite material comprises at least one BMG selected from the group consisting of MgZnCa, MgCuGd, CaMgCu, MgNiMn, AuCuSi, PdCuSi, TiZrNiCu, PdCuNiP, CaMgCu, LaAlCoCuNi, FeCoCrMoCBY, PtNiCuP, and any combination thereof.

Statement 7: The apparatus of any of statements 1-6, wherein the BMG elastomer composite material comprises at least three metals selected from the group consisting of zirconium, copper, silver, aluminum, titanium, nickel, niobium, chromium, tantalum, beryllium, magnesium, a lanthanide, palladium, calcium, platinum, gold, iron, cobalt, yttrium, hafnium, and lithium.

Statement 8: The apparatus of any of statements 1-7, where the BMG elastomer composite material comprises nanofiller in an amount from about 1 wt. % to about 5 wt. %.

Statement 9: The apparatus of any of statements 1-8, the BMG elastomer composite material comprises BMG having nanocrystals in an amount less than 10% by weight of BMG.

Statement 10: The apparatus of any of statements 1-9, wherein the BMG elastomer composite material comprises at least one elastomer selected from the group consisting of a thermoset elastomer, a thermoplastic elastomer, a thermoplastic rubber, a plastomer, and any combination thereof.

Statement 11: The apparatus of any of statements 1-10, wherein the BMG elastomer material comprises at least one elastomer selected from the group consisting of nitrile rubber, hydrogenated nitrile rubber, fluoroelastomer, propylene tetrafluoroethylene, perfluoroelastomer, polyethylene, ethylene propylene diene rubber, ethylene octane copolymer, linear low density polyethylene, ultra-low density polyethylene, a natural rubber, styrene butadiene block copolymer, polyisoprene, polybutadiene, ethylene propylene rubber, ethylene propylene diene rubber, silicone, polyurethane, and any combination thereof.

Statement 12: The apparatus of any of statements 1-11, wherein the one or more sealing elements comprise at least one seal selected from the group consisting of an O-ring, a molded seal, a seal stack, and any combination thereof.

Statement 13: The apparatus of any of statements 1-12, wherein the downhole tool comprises a packer, a plug, or a liner hanger.

Statement 14: The apparatus of any of statements 1-13, wherein a temperature at which a BMG of the BMG elastomer composite material transitions to superplastic flow is within 50° C. of a molding temperature, extrusion temperature, or shaping temperature of at least one elastomer of the BMG elastomer composite material.

Statement 15: A method comprising: deploying a downhole tool into a subterranean formation, wherein the downhole tool comprises one or more sealing elements comprising a bulk metallic glass (BMG) elastomer composite material; positioning the downhole tool at a target downhole location; and forming one or more fluid seals between adjacent regions of the subterranean formation using the one or more sealing elements.

Statement 16: The method of statement 15, wherein the BMG elastomer composite material comprises MgCuY in an amount from about 20 wt. % to about 40 wt. %.

Statement 17: The method of statements 15 or 16, wherein the BMG elastomer composite material comprises at least one elastomer selected from the group consisting of a thermoset elastomer, a thermoplastic elastomer, a thermoplastic rubber, a plastomer, and any combination thereof.

Statement 18: A method comprising: blending one or more bulk metallic glass (BMG) fillers with one or more elastomer powders to form a powdered blend; and shaping the powdered blend and forming a BMG elastomer composite material.

Statement 19: The method of statement 18, further comprising: melting a pre-alloyed feedstock in a vacuum induction furnace of a plasma arc melter to form a molten alloy; cooling the molten alloy at a cooling rate between 105 K/s and 106 K/s; gas atomizing and solidifying the molten alloy to form one or more powders; subjecting the one or more powders to a plasma spheroidization process to obtain the one or more BMG fillers; and curing the BMG elastomer composite material with a bonding agent.

Statement 20: The method of statements 18 or 19, further comprising applying shear force to the powdered blend, wherein the shaping of the powdered blend is performed at or near a temperature at which at least one of the one or more BMG fillers superplastically flows.

For the sake of brevity, only certain ranges are explicitly disclosed herein. However, ranges from any lower limit may be combined with any upper limit to recite a range not explicitly recited, as well as, ranges from any lower limit may be combined with any other lower limit to recite a range not explicitly recited, in the same way, ranges from any upper limit may be combined with any other upper limit to recite a range not explicitly recited. Additionally, whenever a numerical range with a lower limit and an upper limit is disclosed, any number and any included range falling within the range are specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values even if not explicitly recited. Thus, every point or individual value may serve as its own lower or upper limit combined with any other point or individual value or any other lower or upper limit, to recite a range not explicitly recited.

Therefore, the present embodiments are well adapted to attain the ends and advantages mentioned as well as those that are inherent therein. The particular embodiments disclosed above are illustrative only, as the present embodiments may be modified and practiced in different but equivalent manners apparent to those skilled in the art having the benefit of the teachings herein. Although individual embodiments are discussed, all combinations of each embodiment are contemplated and covered by the disclosure. Furthermore, no limitations are intended to the details of construction or design herein shown, other than as described in the claims below. Also, the terms in the claims have their plain, ordinary meaning unless otherwise explicitly and clearly defined by the patentee. It is therefore evident that the particular illustrative embodiments disclosed above may be altered or modified and all such variations are considered within the scope and spirit of the present disclosure.

What is claimed is:

1. An apparatus comprising:

a downhole tool, comprising:

one or more sealing elements comprising a bulk metallic glass (BMG) elastomer composite material, wherein the one or more sealing elements elongate at a temperature from about 121° C. to about 500° C.

2. The apparatus of claim 1, wherein the BMG elastomer composite material comprises an alkaline-earth and rare-earth based BMG.

3. The apparatus of claim 2, wherein the alkaline-earth rare-earth based BMG comprises MgCuY in an amount from about 20 wt. % to about 40 wt. %.

4. The apparatus of claim 3, wherein thermoplastic is present in the BMG elastomer composite material in an amount from about 10 wt. % to about 20 wt. %.

5. The apparatus of claim 1, wherein the BMG elastomer composite material comprises at least one BMG selected from the group consisting of an MG-based BMG, a Zr-based BMG, a Fe-based BMG, a Ni-based BMG, a Cu-based BMG, a Cr-based BMG, a Ti-based BMG, an Al-based BMG, and any combination thereof.

6. The apparatus of claim 1, wherein the BMG elastomer composite material comprises at least one BMG selected from the group consisting of MgZnCa, MgCuGd, CaMgCu, MgNiMn, AuCuSi, PdCuSi, TiZrNiCu, PdCuNiP, CaMgCu, LaAlCoCuNi, FeCoCrMoCBY, PtNiCuP, and any combination thereof.

7. The apparatus of claim 1, wherein the BMG elastomer composite material comprises at least three metals selected from the group consisting of zirconium, copper, silver, aluminum, titanium, nickel, niobium, chromium, tantalum, beryllium, magnesium, a lanthanide, palladium, calcium, platinum, gold, iron, cobalt, yttrium, hafnium, and lithium.

8. The apparatus of claim 1, where the BMG elastomer composite material comprises nanofiller in an amount from about 1 wt. % to about 5 wt. %.

9. The apparatus of claim 1, the BMG elastomer composite material comprises BMG having nanocrystals in an amount less than 10% by weight of BMG.

10. The apparatus of claim 1, wherein the BMG elastomer composite material comprises at least one elastomer selected from the group consisting of a thermoset elastomer, a thermoplastic elastomer, a thermoplastic rubber, a plastomer, and any combination thereof.

11. The apparatus of claim 1, wherein the BMG elastomer material comprises at least one elastomer selected from the group consisting of nitrile rubber, hydrogenated nitrile rubber, fluoroelastomer, propylene tetrafluoroethylene, perfluoroelastomer, polyethylene, ethylene propylene diene rubber, ethylene octane copolymer, linear low density polyethylene, ultra-low density polyethylene, a natural rubber, styrene butadiene block copolymer, polyisoprene, polybutadiene, ethylene propylene rubber, ethylene propylene diene rubber, silicone, polyurethane, and any combination thereof.

12. The apparatus of claim 1, wherein the one or more sealing elements comprise at least one seal selected from the group consisting of an O-ring, a molded seal, a seal stack, and any combination thereof.

13. The apparatus of claim 1, wherein the downhole tool comprises a packer, a plug, or a liner hanger.

14. The apparatus of claim 1, wherein a temperature at which a BMG of the BMG elastomer composite material transitions to superplastic flow is within 50° C. of a molding temperature, extrusion temperature, or shaping temperature of at least one elastomer of the BMG elastomer composite material.

* * * * *